United States Patent [19]

Colucci

[11] Patent Number: 4,896,375

[45] Date of Patent: Jan. 30, 1990

[54] GOLF HAT OR CAP HAVING VISOR WITH MARKING MEANS

[76] Inventor: Donald E. Colucci, 4924 Cleveland Ave., NW., Canton, Ohio 44709

[21] Appl. No.: 333,724

[22] Filed: Apr. 3, 1989

Related U.S. Application Data

[63] Continuation-in-part of Ser. No. 113,625, Oct. 26, 1987, abandoned, which is a continuation-in-part of Ser. No. 864,259, May 5, 1986, abandoned.

[51] Int. Cl.[4] ..... A63B 69/36

[52] U.S. Cl. ..... 2/12; 2/195; 273/183 B

[58] Field of Search ..... 2/12, 195, 199, 171.1, 2/411, 175, 177, 191; 273/183 B, 183 E, 190 A, 190 R; 40/329

[56] References Cited

U.S. PATENT DOCUMENTS

| | | | |
|---|---|---|---|
| 642,440 | 1/1900 | Gerstle | 2/191 |
| 1,163,054 | 12/1915 | Williams | 2/191 |
| 1,169,188 | 1/1916 | Peck | 273/183 B |
| 2,330,442 | 9/1943 | Nero | 273/183 B X |
| 2,874,387 | 2/1959 | Bannister et al. | 2/195 |
| 2,875,447 | 3/1959 | Goldmerstein | 2/171.2 |
| 3,156,211 | 11/1964 | Mallory, Jr. | 273/183 B |
| 3,308,478 | 3/1967 | Tate | 2/12 |
| 3,346,876 | 10/1967 | Hutton | 2/10 |
| 4,023,212 | 5/1977 | Huffman | 2/171.1 |
| 4,063,740 | 12/1977 | Mader | 273/183 B |
| 4,079,940 | 3/1978 | Arakaki | 273/183 B |
| 4,098,509 | 7/1978 | Van Krevelen | 273/183 B |
| 4,307,885 | 12/1981 | Pidcock | 273/183 B |
| 4,549,316 | 10/1985 | Johnson | 2/195 |
| 4,670,910 | 6/1987 | Rosasco | 2/12 X |
| 4,716,599 | 1/1988 | Bell | 2/195 |
| 4,739,991 | 4/1988 | Flinn, Jr. | 273/183 B |

FOREIGN PATENT DOCUMENTS

| | | | |
|---|---|---|---|
| 0633434 | 10/1902 | France . | |
| 1080223 | 5/1954 | France . | |
| 0175468 | 8/1935 | Switzerland | 2/12 |
| 0585529 | 3/1977 | Switzerland . | |
| 1373772 | 11/1974 | United Kingdom | 273/183 B |

*Primary Examiner*—Peter Nerbun

*Attorney, Agent, or Firm*—Oldham & Oldham Co.

[57] ABSTRACT

A golf cap of this invention comprises a headband that grips the golfer's head, and an elongated visor that includes on the inside at least one marker which is plainly visible to the wearer. The visor is permanently attached. The visor is longer than the usual golf cap visor, and is sufficiently long so that the lower edge thereof will be below eye level when the wearer has positioned the hat properly on his head. The marker preferably is in the form of a longitudinally extending line along the centerline of the visor. The golfer wearing this hat addresses the golf ball so that this longitudinal line is aligned with the ball and perpendicular to the proposed line of flight. The hat is an aid to the golfer in keeping his head down and his eye on the ball, because the marking makes him very conscious of any lifting or turning of the head. The side extensions aid the golfer's concentration by reducing any peripheral distractions.

12 Claims, 3 Drawing Sheets

GOLF HAT OR CAP HAVING VISOR WITH MARKING MEANS

CROSS REFERENCE TO RELATED APPLICATION

This is a continuation-in-part of co-pending application Ser. No. 07/113,625 filed on Oct. 26, 1987 which in turn is a continuation-in-part of co-pending application Ser. No. 06/864,259, filed May 5, 1986, now abandoned.

TECHNICAL FIELD

This invention relates to golf hats or caps. More particularly this invention relates to a novel golf hat or cap which aids the golfer in maintaining concentration, addressing and aligning the ball and in keeping his head down and his eye on the ball for a proper golf swing.

BACKGROUND ART

A problem which most golfers face at least to some extent is that of concentration. As a result of lack of concentration, many golfers at least some of the time (and some golfers most of the time) fail to concentrate wholeheartedly when lining up a shot and addressing the ball. As a result the golfer may lift or turn his head, and invariably a poor shot, such as a slice, a hook or a topped ball, results. Golfers are particularly prone to turn their head on the backswing and on the follow-through. On the follow-through, many golfers are prone to turn the head too soon to look down the fairway or across the green to see where the ball is going. Without realizing it, the golfer may begin this turning movement before the ball is actually struck, and a poor shot results. Golf experts universally admonish golfers to keep the head down and the eye on the ball, yet many and perhaps most golfers at least at times lift or turn the head and thus fail to keep the eye on the ball, resulting in a bad shot.

Various devices to aid the golfer in keeping the head down and the eye on the ball have been suggested through the years. These devices typically include some hardware, which may impede the normal golf swing. The purpose of such devices typically is to restrain the golfer from lifting or turning the head. Such devices are awkward and expensive, and are not easily transported from place to place. Consequently, such devices can be used only for instruction and practice, and are not widely used.

Golf hats or caps are well known and are worn by many golfers. Constructions may vary; for example, some golf caps may have an open top while others have a fabric cover that forms a closed top. Although constructions vary, most golf caps comprise a headband which encircles the head of a wearer and a visor extending forwardly therefrom. The universal purpose of presently known golf caps is to protect the wearer from the sun. Golf caps having a closed top may also afford some protection from the rain. Aside from the traditional protection from sun and rain, past and present golf caps serve no other purpose and in particular have not incorporated built-in devices to improve the wearer's game.

DISCLOSURE OF INVENTION

It is an object of this invention to provide a golf hat or cap which will aid the wearer to improve his golf game.

A more specific object is to provide a golf hat or cap which will aid the wearer to address, align, concentrate and minimize movement to properly swing and hit the golf ball.

A related object of this invention is to provide a golf hat or cap which will aid the wearer to address a golf ball properly and to afford some protection from the sun and rain.

These and other objects will be apparent from the drawings and the description which follow.

This invention provides a golf cap for aiding a golfer in addressing and aligning a ball and in keeping his head down and eyes on the ball during a golf swing. This cap comprises means for engaging the head of a wearer and a visor permanently attached thereto. The visor is elongated and extends downwardly and generally forwardly from the upper edge of the lower edge thereof. The upper edge is adapted to engage the wearer's head. The length and angle of inclination of the visor are such that at least a portion of the lower edge is below the wearer's eye level. The inside of the visor includes marking means including at least one mark for indicating whether or not the wearer's eyes are directed straight forward toward the ball. This mark is not visible on the outside of the visor. This mark serves as a point of reference indicating head movement during a golf swing.

The term, "cap" as used herein includes all head coverings, such as hats, caps and headbands whether open or closed at the top, which are suitable for wear while golfing.

BEST MODE FOR CARRYING OUT INVENTION

Figure 1:
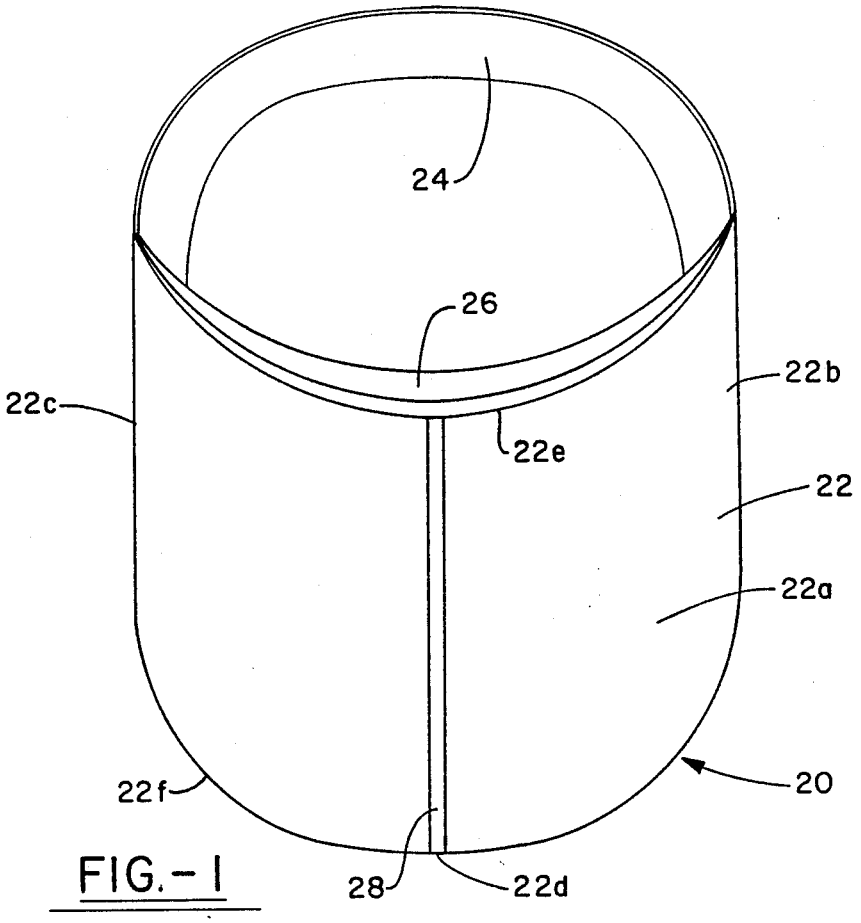
FIG. 1 is a bottom plan view of a golf cap according to a preferred embodiment of this invention, looking up into the inside of the golf cap.
Figure 2:
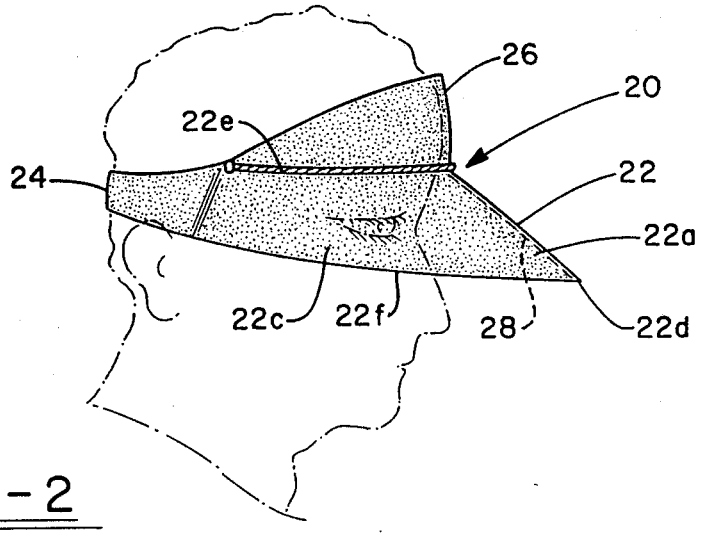
FIG. 2 is a perspective view of the cap according to the embodiment of FIG. 1, shown on the head of a wearer.

The first embodiment of this invention will now be described with reference to FIGS. 1 and 2. Turning now to FIGS. 1 and 2, 20 is a golf cap according to the first embodiment of this invention. Cap 20 comprises a downwardly and generally forwardly sloping wrap-around visor 22 having a downwardly and forwardly sloping front portion 22*a* and essentially vertical side portions 22*b* and 22*c*, a back strap 24 which is attached to the side portions 22*b* and 22*c* of visor 22, and an essentially upright front panel 26. Visor 22 is joined to front panel 26 along the upper (or rear) edge 22*e* of the visor. The front and side portions 22*a*, 22*b*, respectively of visor 22 extend from upper edge 22*e* to lower (or forward) edge 22*f*. Upper edge 22*e* typically lies in one plane; lower edge 22*f* also typically lies in one plane. Upper edge 22*e* is adapted to engage the head of the wearer, preferably on a curved line extending from the mid-portion of the forehead to the sides of the head above the ears.

Visor 22 is longer in front than the conventional golf cap visor. The length of visor 22 is typically about 4.5 to 6 inches. This length is measured along the visor's centerline from tip 22*d* (which is at the intersection of lower edge 22*f* with the centerline) upwardly to the upper edge 22*e* of visor 22. Visor 22 is also downwardly inclined at a greater angle than in a conventional visor. The length and angle of inclination of visor 22 are such that tip 22*d* (and generally the entire lower edge 22*f*) of visor 22 will be below the eye level of the wearer when the wearer is wearing the cap normally (as shown in FIG. 2) and is standing erect with his eyes looking straight forward. This feature is important because this extra length shuts out potential distractions which he otherwise would see by looking straight ahead.

The sides 22*b*, 22*c* of visor 22 are nearly verticle, extending slightly outward as they extend down. These sides engage the head of the wearer in the vicinity of the ears. The sides extend below eye level and thus form side shields which shut out distractions to the side. Visor 22 is a continuous curved surface so that there is no sharp line of demarcation between the front portion 22*a* and the side portions 22*b* and 22*c*.

Visor 22 may be made of a stiff material, such as rigid plastic or waterproofed paper or cardboard. Alternatively, visor 22 may be made of a deformable material which will return to its original shape, such as a plastic material with memory, or a composite, e.g. a fabric cover and thin stiffening member which is formed to the desired shape and concealed by the fabric cover.

A back strap or headband 24 is permanently attached to the sides 22*b*, 22*c* of visor 22 in order to engage the back of the head of wearer and hold the gold cap 20 on the wearer's head. Back strap 24 may be conventional and is preferably adjustable to accommodate heads of various sizes. Back strap or headband 24 may be of suitable plastic or fabric material, for example an elasticized material or a plastic which preferably has means such as fasteners for adjusting the length of strap 24.

Visor 22 and back strap 24 between them extend around the entire circumference of the wearer's head and engage the head. The top edge 22*e* of visor 22 and the top edge of back strap 24 form a closed line which encircles the wearer's head and assumes the shape thereof. This represents the line of closest engagement between the cap 20 and the head of the wearer. This line typically lies in one plane. When the cap 20 is worn normally, this line substantially coincides with the maximum circumference of the wearer's head, which is a closed line extending from the wearer's forehead (at the mid-portion thereof) to the back of the head via the sides at the widest portion of the head, which is a short distance above the ears. When cap 20 is worn normally, it will not be tilted toward one side, nor will it be pulled forward so that upper edge 22*e* of visor 22 engages the head near the eyebrows, nor pushed back so that the upper edge of the visor engages the head close to the hairline. The cap 20 is worn normally for addressing the ball and swinging the club. When cap 20 is worn normally, the lower edge 22*f* of visor 22 is below the wearer's eye level so as to shut out distractions.

Front panel 26 extends upwardly from the top edge of visor 22. Front panel 26 is typically of fabric, and is ornamental. It may be omitted if desired. However, the front panel provides a handy place for insignia, such as the name of a business establishment which sponsors a golf league. Front panel 26 may be secured to visor 22 by any suitable means such as glueing or stitching.

A mark 28, preferably in the form of a straight line on the inside of visor 22 extending from tip 22*d* upwardly to the top edge of the visor, along the visor's centerline (from left to right), is provided as an aid to the wearer in properly addressing a golf ball. Line 28 may be stitched or imprinted or formed by other suitable means, but must be clearly visible to the wearer. This mark is invisible on the outside of visor 22, so that others will not see it. When a wearer, addressing a golf ball, is standing so that the golf ball lies along an extension of line 28, his eyes are directed straight forward, perpendicular to the desired line of flight of the ball, and he is addressing the golf ball properly. When a golfer moves his head, the line 28 moves relative to the ball. Thus line 28 serves as a point of reference indicating head movement during a golf swing.

A second and preferred embodiment of this invention will now be described with reference to FIGS. 3 and 4.

Figure 3:
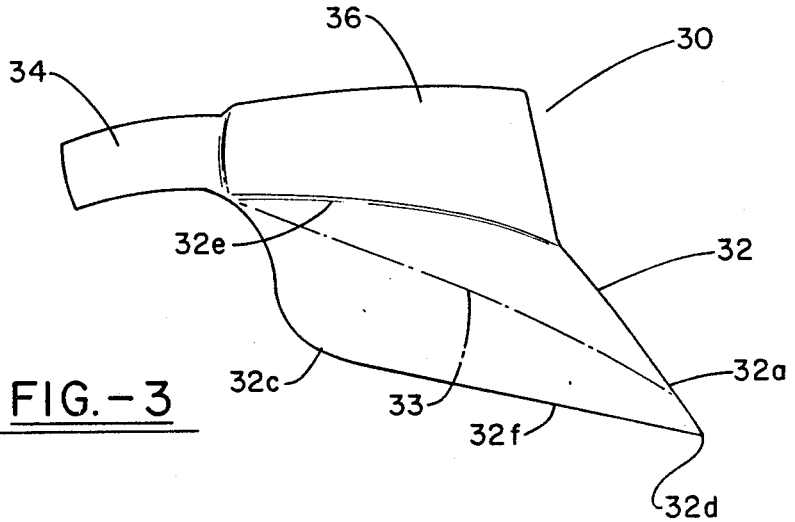
FIG. 3 is a perspective view of a golf cap according to a second embodiment of this invention.
Figure 4:
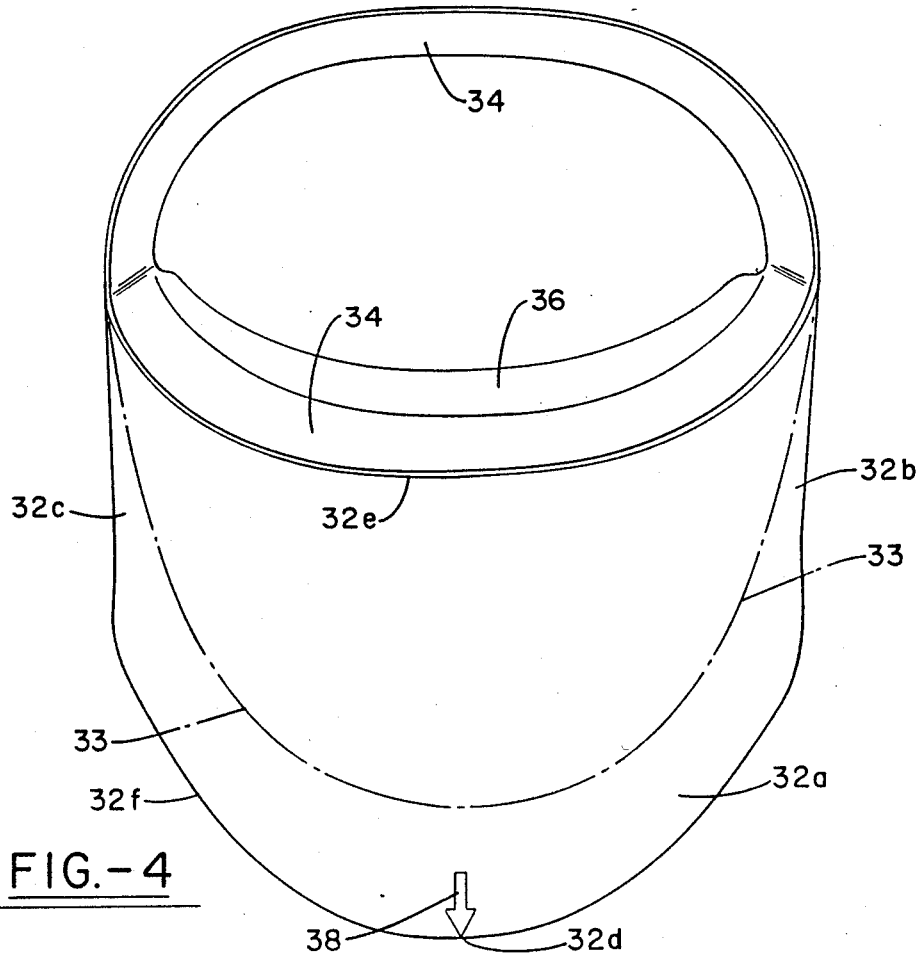
FIG. 4 is a bottom plan view of the golf cap according to the second embodiment of the invention.

Referring to FIGS. 3 and 4, 30 is a cap according to the second embodiment. Cap 30 comprises a visor 32 of somewhat larger than normal size, a headband 34 which extends around the entire perimeter of the cap 30 so that it encircles the wearer's head, and a front panel 36 which conceals front portion of headband 34. The front portion of headband 34 lies flush against the inside of front panel 36. The lower edges of front panel 36 and front portion of headband 34 preferably coincide or are nearly coincident. Visor 32 is permanently joined along its upper edge 32*e* to headband 34 and front panel 36. Visor 32 slopes downwardly and generally forwardly from its upper edge 32*e* to its lower edge 32*f*. Upper edge 32*e* typically lies in one plane. Lower edge 32*f* typically lies in one plane except at its ends (which are at the sides of cap 30), where it comes upwardly and intersects upper edge 32*e*.

Visor 32 of this invention is longer in front, and both longer and fuller on the sides than a conventional cap visor. Visor 32 has a downwardly and forwardly sloping front portion 32*a* and side portions 32*b*, 32*c* which slope downardly more steeply than front portion 32*a*. Preferably, however, the angle of inclination, or slope angle, of the front portion 32*a* of the visor is slightly steeper than than of a conventional golf cap visor, e.g. at least about 40° and preferably about 45°-50°, vs. about 30°-35° in a conventional golf cap. The slope angle is the angle between the center axis of visor 32 (which is a line extending from the top edge 32*e* of the visor to the visor tip 32*d*) and the plane of the top edges 32*e*. The angle of inclination of front portion 32*a* may be about the same as in a conventional golf cap visor. As may be seen in the drawings, golf cap 30 according to this invention is slightly longer in front (at 32*e*) and much longer along sides 32*b*, 32*c* (as measured by the distance between front panel 36 and the forward edge of the visor 32) than a conventional golf cap. Dotted line 33 shows the forward edge of a conventional golf cap. As a result, the lower edge 32*f* (except the end portions) of visor 32 is below the wearer's eye level when the wearer is standing erect and wearing cap 30 normally. This is an aid in shutting out distractions in the golfer's field of vision both straight ahead and to the sides, as the golfer addresses the ball and swings the club. Cap 30 is worn normally when the lower edge of the headband 34 and the upper edge 32*e* of visor 32 substantially coincide with the maximum circumference of the wearer's head.

Figure 5:
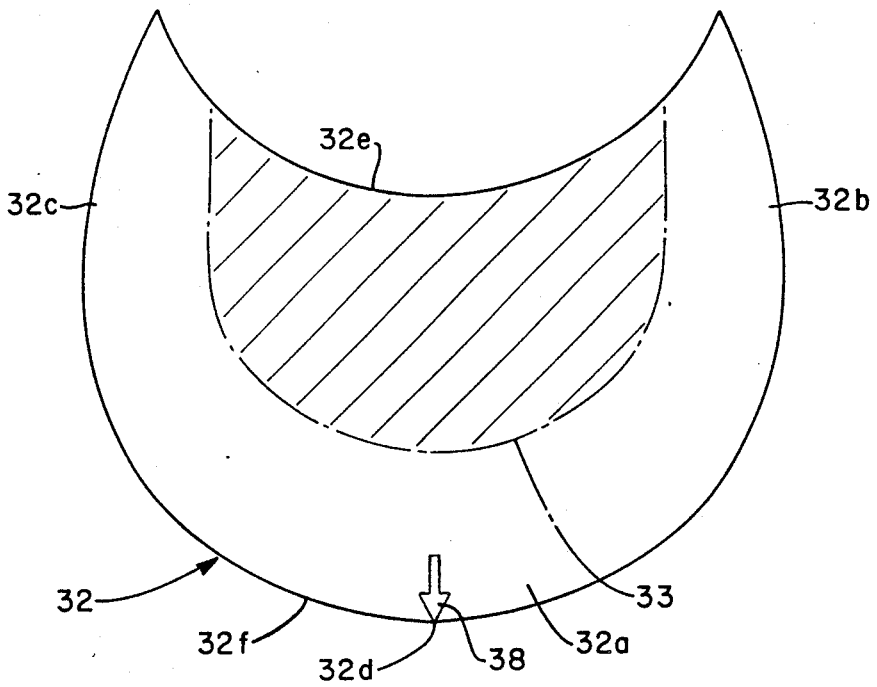
FIG. 5 is a plan view of a visor in a cap according to the second embodiment of the invention as it would appear if flattened out.

FIG. 5 shows visor 32 as it would appear in plan if flattened out. Line 33 represents the forward edge of a conventional golf cap visor if similarly flattened out.

The shaded area is the area of a conventional golf cap. The length of visor 32, measured from the visor's upper edge 32*e* to its lower or forward edge 32*f* (i.e. to tip 32*d*) along the visor's centerline, is typically 4.5 to 5.5 inches, compared to 3 to at most 4 inches and usually not over 3.5 inches, in a conventional golf cap. The maximum width of visor 32 is typically at least 10 inches, compared to 8 to 10 inches (typically 8.5 to 9.5 inches) in a standard golf cap. The area of visor 32 is substantially greater, typically about 35 percent greater, than that of a conventional golf cap visor. (This percentage can vary, since there are some variations in area of both visors according to this invention and conventional golf cap visors).

A representative golf cap 30 according to this invention (and shown in FIGS. 3–5) has the following dimensions: visor length (measured along the center axis from top edge 32*e* to tip 32*d*, 4¼ inches; maximum visor width (when flattened), 10½ inches; visor slope angle (measured as above described), about 45°–50°. In comparison, a commercial golf cap, which is believed to be representative, has the corresponding dimensions as follows: visor length, 3 inches; maximum visor width (when flattened), 9 inches; visor slope angle, about 35°.

A mark 38, shown as an arrow on the inside of visor 32, extending along the centerline and terminating at tip 32*d*, is provided as an aid to the wearer in properly addressing a golf ball. Line 38 may be imprinted or formed by suitable means, but must be clearly visible to the wearer. Mark 38 is not visible on the outside of visor 32. When a wearer, addressing a golf ball, is standing so that the golf ball lies along an extension of line 38, he is addressing the golf ball properly.

Except for the size, shape and slope angle of visor 32, the materials, dimensions and construction of golf cap 30 may be similar to those in conventional golf caps. Thus, headband 34 may be adjustable, e. g. by being made of an elasticized fabric or by having spaced fasteners and eyelets in the back. Front panel 36 is nearly vertical (it should follow the contour of the wearer's forehead) and is primarily a sweat band but is also decorative. Visor 32, headband 34 and front panel 36 may be joined together by means such as glueing or stiching.

The front portion of headband 34 (the portion concealed by front panel 36) may be omitted (with some decrease in comfort) if desired. In this case the back (or visible) portion of headband 34 may be joined to front panel 36 by conventional means such as stiching. An adjustable back strap, which may be similar to back strap 24 in FIGS. 1 and 2, may constitute the back portion of headband 34.

Golf hats and caps according to this invention may be of various designs. The hat or cap may be of totally new design (as for example the first embodiment illustrated herein) or a modification of an existing golf hat or cap (as for example the second embodiment illustrated herein). For example, a tam-o-shanter may be modified in accordance with this invention. The hat may have a brim instead of a visor; however, the brim should be more downturned than is the case of a conventional hat with a brim, and must have a marking (preferably a straight line along the hat's centerline in front) on the inside of the brim in the wearer's field of vision. The length and angle of inclination of the visor or brim should be such that the tip of the visor or brim is below eye level so as to blot out distractions straight ahead. The front and side portions of the lower (or forward) edge of the visor or brim are below eye level, so as to blot out distractions to the sides as well as those directly ahead.

Either a line such as 28 or an arrow such as 38 may be used with either embodiment of the invention. Line 28 and arrow 38 may be replaced by other forms of marking on the inside of visors 22 or 32. Either line may be replaced by a dot on the centerline, or by a pair of dots or upwardly extending lines which are spaced equidistantly to the right and the left of the visor's centerline. There must be a clearly visible marking on the inside of the visor 20 or 30, and a single straight line such as 28 along the visor's centerline is preferred. The marking may take a form which is visible on the outside of the visor, and therefore visible to others as well as the wearer, but the preferred markings are those which are invisible on the outside of the visor and therefore visible only to the wearer.

When the golfer is not addressing a ball, e.g. when he is walking along a fairway, he can push the cap 20 or 30 back on his head so that tip 22*d* or 32*d* is above eye level.

A golf cap 20 or 30 of this invention is in one piece as manufactured. No additional pieces of hardware have to attached in order for the cap to function as intended. This is an important advantage, since such extra pieces of hardware may become lost or misplaced or may be attached improperly.

A golf hat or cap according to this invention provides an inexpensive and reliable means to encourage a golfer to address a ball properly and to keep his head down and his eye on the ball until after the ball has been struck. Furthermore, the hat or cap can be worn during actual play, and is not confined to use in practice.

While in accordance with the patent statutes the best mode and preferred embodiment of the invention have been illustrated and described in detail, it is to be understood that the invention is not limited thereto, but that the scope is defined by the appended claims.

What is claimed is:

1. A golf cap for aiding a golfer in addressing a ball and in keeping his eyes on the ball during a golf swing, said cap comprising means including a headband for encircling the head of a wearer and a visor permanently attached thereto, said visor having an upper edge and a lower edge and being joined along its upper edge to said means, said visor being elongated and sloping downwardly and generally forwardly from the upper edge to the lower edge thereof, the length of said visor, measured along the centerline thereof, being at least about 4 inches, said upper edge being adapted to engage the wearer's head, at least a portion of said lower edge being below eye level when said cap is worn normally, said visor including marking means which is imprinted or stitched on the inside thereof so as to be immovable with respect to the visor, said marking means being invisible upon viewing the outside of the visor, said marking means including at least one mark for indicating whether or not the wearer's eyes are directed straight forward toward the ball, said mark serving as a point of reference indicating head movement during a golf swing.

2. A golf cap according to claim 1 wherein the length and the angle of inclination of said visor are such that the tip of the visor is below the wearer's eye level when the wearer is standing erect and the hat or cap is worn normally.

3. A golf cap according to claim 1 wherein said visor has an elongated center portion and side portions extending from said upper edge to said lower edge, said center portion extending downwardly and forwardly and said side portions extending downwardly at a steeper angle than said center portion, so that the lower parts of said center and side portions are below the wearer's eye level.

4. A golf cap according to claim 1 wherein said marking means includes a marking on the centerline of said visor.

5. A golf cap according the claim 4 wherein said mark is a line extending along the centerline of the visor.

6. A golf cap according to claim 1 in which said headband extends around the entire perimeter of the hat or cap.

7. A golf cap according to claim 1 in which said mark is invisible on the outside of the visor.

8. A golf cap according to claim 1 wherein the maximum width of said visor is at least about 10 inches.

9. A golf cap according to claim 1 wherein the lower edge of said visor, except for the end portions thereof, lies essentially in a common plane.

10. A golf cap according to claim 1 wherein the slope angle of said visor is at least about 40°.

11. A golf cap according to claim 1 wherein said visor is joined along its upper edge to the lower edge of said means for encircling the head of a wearer.

12. A golf cap according to claim 9 further including a front panel and wherein said visor is permanently joined along its upper edge to said headband and said front panel.

* * * * *